United States Patent [19]

Uemura et al.

[11] Patent Number: 4,579,645

[45] Date of Patent: Apr. 1, 1986

[54] STARTING PITCH FOR CARBON FIBERS

[75] Inventors: Seiichi Uemura, Tokyo; Hiroaki Takashima, Kawasaki; Osamu Kato; Michiharu Harakawa, both of Yokohama, all of Japan

[73] Assignee: Nippon Oil Company, Limited, Japan

[21] Appl. No.: 484,155

[22] Filed: Apr. 12, 1983

[51] Int. Cl.[4] ..... D01F 9/12; C10C 3/02

[52] U.S. Cl. ..... 208/23; 208/22; 208/39; 423/447.1; 423/447.2; 423/447.4; 264/29.2

[58] Field of Search ..... 208/23, 45, 39, 309; 423/447.1–447.4; 264/29.2

[56] References Cited

U.S. PATENT DOCUMENTS

| | | | |
|---|---|---|---|
| 2,030,575 | 2/1936 | Ellms | 208/360 |
| 3,330,759 | 7/1967 | Henschel et al. | 208/44 |
| 3,970,542 | 7/1976 | Bongertman | 208/44 |
| 4,176,043 | 11/1979 | van Eijk | 208/44 |
| 4,188,235 | 2/1980 | Espenscheid et al. | 208/44 |
| 4,211,633 | 7/1980 | Gleim | 208/309 |
| 4,301,135 | 11/1981 | Nazem et al. | 264/29.2 |
| 4,318,824 | 3/1982 | Turner | 208/45 |
| 4,324,651 | 4/1982 | Rollmann et al. | 208/309 |

FOREIGN PATENT DOCUMENTS

| | | | |
|---|---|---|---|
| 0006976 | 3/1978 | Japan | 208/44 |

*Primary Examiner*—Andrew H. Metz
*Assistant Examiner*—Helane Myers
*Attorney, Agent, or Firm*—Scully, Scott, Murphy & Presser

[57] ABSTRACT

Provided is a starting pitch for producing carbon fiber by heat-treating the starting pitch to obtain a precursor pitch, melt-spinning the precursor pitch, then rendering the resultant pitch fiber infusible, followed by carbonization, and further followed by graphitization if required, the starting pitch comprising a mixture of (a) 100 parts by weight of a pitch and (b) 5 to 500 parts by weight of a methanol-insoluble and benzene-soluble component contained in a heavy oil obtained in a fluid catalytic cracking of petroleum, the heavy oil having a boiling range not lower than 200° C.

17 Claims, No Drawings

STARTING PITCH FOR CARBON FIBERS

BACKGROUND OF THE INVENTION

The present invention relates to a pitch having superior properties as a starting material for the production of carbon fibers.

In recent years there have been reported a number of methods for preparing carbon fibers from pitches.

For example, it has been reported that a carbon fiber having improved elastic modulus and strength is obtainable by heat-treating a commercially available petroleum pitch to obtain a pitch containing an optically anisotropic liquid crystal called mesophase, using this mesophase-containing pitch as a precursor pitch (the pitch used in melt spinning will be hereinafter referred to as "precursor pitch"), then melt-spinning the precursor pitch, rendering the resultant pitch fiber infusible, followed by carbonization and subsequent graphitization if required (see Japanese Patent Laying Open Print No. 19127/1974).

However, many of commercial petroleum pitches and other synthetic pitches, when heat-treated for preparation of the precursor pitch, allow production of high molecular weight components insoluble in quinoline. More particularly, heat treatment of these pitches causes both a thermal decomposition and a polycondensation reaction, whereby low molecular weight components gradually increase in their molecular weight and become high molecular weight components insoluble in quinoline, and at the same time originally high molecular weight components are further increased in their molecular weight. The softening point of the pitch also rises. The presence of a large amount of such quinoline insolubles and the high softening point exert a bad influence at the subsequent melt spinning step. That is, for melt-spinning the precursor pitch, it is necessary to raise the spinning temperature until the viscosity of the precursor pitch becomes a spinnable viscosity. In this case, if the softening point of the precursor pitch is too high, it is inevitably required that the spinning temperature be also raised to the same degree. As a result, not only quinoline insolubles further increase in their molecular weight but also there occurs a thermal decomposition of the pitch to produce a light gas, thus making it impossible to obtain a uniform precursor pitch, that is, it actually becomes impossible to effect spinning of the pitch.

Thus, the precursor pitch must have a relatively low softening point and a viscosity suitable for spinning. Further, it must be substantially free from volatile components during spinning and also during carbonization.

In order to satisfy the above-mentioned requirements, there have been adopted such means as pressure filtration and solvent fractionation for removing the produced quinoline insolubles to thereby prepare a precursor pitch to use for the production of carbon fibers (see Japanese Patent Laying Open Print Nos. 9804/1972, 142820/1975, 1342/1980 and 5954/1980). However, the use of such means requires a more complicated treating apparatus and an increased treating cost, and thus is not desirable from the economic point of view.

SUMMARY OF THE INVENTION

It is an object of the present invention to eliminate the above-mentioned drawbacks of the prior art.

It is another object of the present invention to provide a pitch having superior properties as a starting pitch for the production of carbon fibers.

It is a further object of the present invention to provide a starting pitch not permitting a substantial production of high molecular weight components as quinoline insolubles at the stage of heat treatment for the preparation of a precursor pitch.

It is a still further object of the present invention to provide a starting pitch having superior properties, capable of suppressing the production of high molecular weight components at the precursor pitch preparing stage, having an optimum viscosity and capable of having a composition which permits aromatic planes to be easily arranged in an orderly manner at an initial stage of carbonization.

It is still another object of the present invention to provide a starting pitch whose softening point is held at a relatively low value and which can be easily graphitized.

The above-mentioned objects of the present invention can be achieved by using as a starting pitch a mixture of (a) 100 parts by weight of a pitch and (b) 5 to 500 parts by weight of a methanol-insoluble and benzene-soluble component from heavy oils boiling at not lower than 200° C. obtained in fluid catalytic cracking of petroleums, in the production of carbon fiber by heat-treating the starting pitch, melt-spinning the precursor pitch thereby obtained, then rendering the resultant pitch fiber infusible, followed by carbonization and subsequent graphitization if required.

In case the starting pitch of the present invention is heat-treated to obtain a precursor pitch, not only the production of quinoline insolubles is suppressed, but also the pitch is modified and a carbon fiber having a high elastic modulus and a high strength is obtainable as a final product. These advantages are completely beyond anticipation.

DESCRIPTION OF THE PREFERRED EMBODIMENTS

Examples of the pitch used as component (a) in the present invention include coal pitches such as coal tar pitch and coal liquefaction pitch, petroleum pitches such as ethylene tar pitch and decant oil pitch, as well as synthetic pitches, with petroleum pitches being particularly preferred.

It is also preferable in the present invention that the above pitches be subjected to a modification treatment before their use. As modified pitches which may be used in the invention, mention may be made of the starting pitches disclosed in Japanese Patent Laying Open Print Nos. 168987/1982, 168988/1982, 168990/1982, 168989/1982, 170990/1982, 179285/1982, 179286/1982, 179287/1982, 179288/1982, 18419/1983 and 18420/1983.

The component (b) used in the present invention is a methanol-insoluble and benzene-soluble component from heavy oils boiling at not lower than 200° C. obtained in fluid catalytic cracking of petroleums.

It is also particularly preferable that the said heavy oil be heat-treated or treated under hydrogen pressure in advance of its treatment with methanol and benzene.

More particularly, a heavy oil boiling substantially in the range of 200° to 700° C. by-produced in the production of a light oil such as gasoline by a fluid catalytic cracking of petroleum such as kerosene, gas oil or bottom residue in atmospheric distillation usually at a temperature ranging from 450° to 550° C., at a pressure ranging from atmospheric pressure to 20 kg/cm$^2$·G, in the presence of a natural or synthetic silica-alumina catalyst or zeolite catalyst, or a pitch obtained by treating the said heavy oil for 10 minutes to 20 hours at a temperature ranging from 370° to 480° C., preferably 390° to 460° C., and at a pressure ranging from 2 to 50 kg/cm$^2$·G, preferably 5 to 30 kg/cm$^2$.G, or a pitch obtained by treating the said heavy oil under a hydrogen pressure not lower than 20 kg/cm$^2$.G, for example, ranging from 20 to 350 kg/cm$^2$·G, preferably 50 to 300 kg/cm$^2$.G, and at a temperature ranging from 350° to 500° C., preferably 370° to 480° C., more preferably 390° to 460° C., is treated with methanol and benzene to obtain a methanol-insoluble, benzene-soluble component, preferably a component insoluble in a mixed methanol-benzene solvent (2:1 in weight ratio) and soluble in benzene, most preferably a component insoluble in a mixed methanol-benzene solvent (1:1 in weight ratio) and soluble in benzene, and this component is used as component (b) in the present invention.

The method for obtaining such component insoluble in methanol or in a mixed methanol-benzene solvent and soluble in benzene is not specially limited. As an example, 5 to 100 parts by weight, based on the weight of the aforementioned heavy oil or pitch, of methanol or a mixed methanol-benzene solvent is added and insoluble matter is separated. Then, 5 to 100 parts by weight, based on the weight of the separated insoluble matter, of benzene is added to the insoluble matter and thereafter benzene-insoluble matter is separated, while benzene-soluble matter is treated in known manner to remove benzene to obtain the component (b) in the present invention.

The mixing ratio of the components (a) and (b) is such that the proportion of component (b) is in the range of 5 to 500, preferably 10 to 300, parts by weight based on 100 parts by weight of component (a).

In heat-treating the starting pitch of the invention thus obtained to prepare a precursor pitch, not only the production of high molecular weight components as quinoline insolubles is suppressed but also the rise in softening point of the pitch can be prevented, and further the precursor pitch has a composition permitting aromatic planes to be arranged easily in an orderly manner. As a result, there can be obtained carbon fibers extremely superior in elastic modulus and strength.

The production of carbon fiber using the starting pitch of the invention may be conducted in known manner. That is, the precursor pitch obtained by heat-treating the starting pitch is subjected to melt spinning, then to infusiblization treatment and carbonization, and to subsequent graphitization if required, to obtain carbon fiber.

The reaction at the stage of heat-treating the starting pitch to obtain the precursor pitch is carried out usually by introducing an inert gas such as nitrogen at a temperature in the range of 340° to 450° C., preferably 370° to 420° C., and at an atmospheric or reduced pressure. In this case, the heat treating time may vary according to conditions such as the heat treating temperature, the amount of inert gas introduced, etc., but usually ranges from 1 to 50 hours, preferably 3 to 20 hours. The amount of inert gas introduced is preferably in the range of 0.7 to 5.0 scfh/lb pitch.

The precursor pitch may be melt-spun by a conventional method such as the extrusion method, centrifugal method or spray method. The melt spinning temperature ranges usually from 150° to 400° C., preferably 200° to 350° C.

The resultant pitch fiber is then rendered infusible in an oxidizing gas atmosphere. As the oxidizing gas, there may be used one or more of oxidizing gases such as oxygen, ozone, air, nitrogen oxide, halogen and sulfurous acid gas. This treatment for rendering the pitch fiber infusible is carried out under a temperature condition under which the melt-spun pitch fiber being treated does not soften and change in shape, for example, at a temperature in the range of 20° to 400° C., preferably 20° to 360° C. The duration of this treatment usually ranges from 5 minutes to 10 hours.

The pitch fiber thus rendered infusible is then subjected to carbonization, and further to graphitization if required, in an inert gas atmosphere to obtain carbon fiber. The carbonization treatment is carried out at a temperature usually ranging from 800° to 2,500° C. Generally, the time required for carbonization is 0.5 minute to 10 hours. Subsequently, graphitization may be performed, if required, at a temperature in the range of 2,500° to 3,500° C. for usually 1 second to 1 hour.

During the treatment for rendering the pitch fiber infusible or for carbonizing or graphitizing it, the pitch fiber being treated may be held under a slight load or tension for the purpose of preventing shrinkage or deformation.

The following examples and comparative examples are given to further illustrate the present invention, but it is to be understood that the invention is not limited thereto.

EXAMPLE 1

A heavy oil (A), properties of which are shown in Table 1, with a boiling point not lower than 200° C. by-produced in steam cracking of naphtha at 830° C. was heat-treated at 400° C. under a pressure of 15 kg/cm$^2$·G for 3 hours and then distilled at 250° C./1 mmHg to obtain a fraction (B) boiling in the range of 160° to 400° C., properties of which are set out in Table 2. The fraction (B) was contacted with hydrogen at a pressure of 35 kg/cm$^2$·G, a temperature of 330° C. and a liquid hourly space velocity (LHSV) of 1.5 in the presence of a nickel-molybdenum catalyst (NM-502), thereby allowing a partial nuclear hydrogenation to take place, to obtain a hydrogenated oil (C). The percentage nuclear hydrogenation was 31%.

50 parts by volume of the heavy oil (A) and 50 parts by volume of the hydrogenated oil (C) were mixed together and heat-treated at 430° C. under a pressure of 20 kg/cm$^2$.G for 3 hours. The heat-treated oil thus obtained was distilled at 250° C./1.0 mmHg to distill off the light fraction to obtain a pitch (1) having a softening point of 54° C. and a benzene insoluble content of 0.9 wt. %.

A vacuum-distilled gas oil (VGO) from Arabic crude oil was subjected to catalytic cracking at 500° C. in the presence of a silica-alumina catalyst to obtain a heavy oil (D) with a boiling point not lower than 200° C., properties of which are shown in Table 3.

The heavy oil (D) was heat-treated at 430° C. under a pressure of 15 kg/cm$^2$.G for 3 hours, and then distilled at 250° C./1.0 mmHg to distill off the light fraction to obtain a pitch (2) having a softening point of 85° C. and a benzene insoluble content of 20 wt. %.

Then, after grinding the pitch (2), a mixed methanol: benzene (1:1 in weight ratio) solvent was added in an amount 30 times the amount of the pitch (2), and the resultant mixture was stirred under heating at 130° C. at atmospheric pressure for 1 hour, followed by centrifugal separation to separate insoluble matter. Then, to the separated insoluble matter was added benzene in an amount 30 times the weight of the insoluble matter, and the mixture was stirred under heating at 150° C. at atmospheric pressure for 1 hour, followed by centrifugal separation to separate soluble matter, from which was then removed benzene in known manner to obtain a pitch (3) having a softening point of 45° C. in 40% yield.

Then, the pitch (1) and the pitch (3) were mixed together at a weight ratio of 1:0.5, and 30 g. of this mixture was heat-treated at 400° C. for 10 hours while nitrogen was introduced at a rate of 600 ml/min, to obtain a pitch having a softening point of 280° C., a quinoline insoluble content of 30 wt. % and a mesophase content of 85%. Thus pitch thus obtained was melt-spun at 330° C. by means of a spinning apparatus having a nozzle diameter of 0.3 mm and an L/D ratio of 2.0 to obtain pitch fiber of 12–17μ. The pitch fiber thus obtained was then rendered infusible, carbonized and graphitized under the following conditions to obtain carbon fiber.

Infusiblization Condition: Heat in an air atmosphere at a rate of 3° C./min up to 200° C. and 1° C./min up to 300° C., and hold at 300° C. for 15 minutes.

Carbonization Condition: Heat in a nitrogen atmosphere at a rate of 5° C./min and hold at 1,000° C. for 30 minutes.

Graphitization Condition: Heat in an argon gas stream up to 2,500° C. at a rate of 25° C./min.

The carbon fiber thus obtained proved to have a tensile strength of 305 kg/mm$^2$ and a Young's modulus of 60 ton/mm$^2$.

TABLE 1

| Properties of heavy oil (A) | | |
|---|---|---|
| Specific Gravity (15° C./4° C.) | | 1.039 |
| Distillation Property | Initial boiling point | 192° C. |
| | 5% | 200 |
| | 10% | 206 |
| | 20% | 217 |
| | 30% | 227 |
| | 40% | 241 |
| | 50% | 263 |
| | 60% | 290 |
| | 70% | 360 |

TABLE 2

| Properties of fraction (B) | | |
|---|---|---|
| Specific Gravity (15° C./4° C.) | | 0.991 |
| Refractive Index ($n_D25$) | | 1.5965 |
| Molecular Weight | | 145 |
| Distillation Property | Initial boiling point | 160° C. |
| | 10% | 200 |
| | 30% | 215 |
| | 50% | 230 |
| | 70% | 256 |
| | 90% | 305 |

TABLE 3

| Propertiies of heavy oil (D) | | |
|---|---|---|
| Specific Gravity (15° C./4° C.) | | 0.965 |
| Distillation Property | Initial boiling point | 320° C. |
| | 5% | 340 |
| | 10% | 353 |
| | 20% | 370 |
| | 30% | 385 |
| | 40% | 399 |

TABLE 3-continued

| Propertiies of heavy oil (D) | | |
|---|---|---|
| | 50% | 415 |
| | 60% | 427 |
| | 70% | 445 |
| | 80% | 467 |
| | 90% | 512 |
| Viscosity cSt # 50° C. | | 18.21 |

Comparative Example 1

30 g. of the pitch (1) obtained in Example 1 was heat-treated at 400° C. for 10 hours with stirring while introducing nitrogen at a rate of 600 ml/min, to obtain a pitch having a softening point of 274° C., a quinoline insoluble content of 19.5% and a mesophase content of 53%. The pitch thus obtained was melt-spun at 334° C. by means of the spinning apparatus used in Example 1 to obtain pitch fiber of 11–15μ, which was then rendered infusible, carbonized and graphitized in the same manner as in Example 1 to obtain carbon fiber.

The carbon fiber thus obtained proved to have a tensile strength of 250 kg/mm$^2$ and a Young's modulus of 37.5 ton/mm$^2$.

Comparative Example 2

The pitches (1) and (2) obtained in Example 1 were mixed together at the same mixing ratio of 1:0.5 as in Example 1, then this mixed pitch was heat-treated in the same way as in Example 1 to obtain a pitch having a softening point of 350° C., a quinoline insoluble content of 45 wt. % and a mesophase content of 85%. The pitch thus obtained was melt-spun at 350° C. by means of the spinning apparatus used in Example 1 to obtain pitch fiber of 15–20μ, which was then rendered infusible, carbonized and graphitized in the same manner as in Example 1 to obtain carbon fiber. This carbon fiber proved to have a tensile strength of 265 kg/mm$^2$ and a Young's modulus of 41 ton/mm$^2$.

EXAMPLE 2

Using the pitch (2) obtained in Example 1 and in the same way as in Example 1 there was obtained a methanol-insoluble, benzene-soluble pitch (4) in 57% yield, whose softening point was 38° C.

Then, the pitch (1) shown in Example and the pitch (4) just prepared above were mixed together at a weight ratio of 1:0.5, and subsequently this mixed pitch was heat-treated in the same manner as in Example 1 to obtain a pitch having a softening point of 275° C., a quinoline insoluble content of 28 wt. % and a mesophase content of 75%.

The pitch thus obtained was melt-spun at 327° C. by means of the spinning apparatus used in Example 1 to obtain pitch fiber of 15–20μ, which was then rendered infusible, carbonized and graphitized in the same way as in Example 1 to obtain carbon fiber, whose tensile strength and Young's modulus were 275 kg/mm$^2$ and 50 ton/mm$^2$, respectively.

EXAMPLE 3

The heavy oil (A) used in Example 1 was heat-treated at 400° C. under a pressure of 15 kg/cm$^2$·G for 3 hours. The heat-treated oil thus obtained was distilled at 250° C./1 mmHg to distill off the light fraction to obtain a pitch (5) having a softening poing of 82° C.

The pitch (5) just obtained above and the pitch (3) shown in Example 1 were mixed together at a weight ratio of 1:1, and 30 g. of this mixed pitch was heat-treated at 400° C. for 6 hours with stirring while introducing nitrogen at a rate of 600 ml/min, to obtain a pitch having a softening point of 290° C., a quinoline insoluble content of 32 wt. % and a mesophase content of 85%.

The pitch thus obtained was melt-spun at 340° C. by means of the spinning apparatus used in Example 1 to obtain pitch fiber of 13–16μ, which was then rendered infusible, carbonized and graphitized in the same way as in Example 1 to obtain carbon fiber. The tensile strength and Young's modulus of this carbon fiber were 240 kg/mm$^2$ and 39 ton/mm$^2$, respectively.

Comparative Example 3

The pitch (5) shown in Example 3 and the pitch (2) shown in Example 1 were mixed and heat-treated in the same way as in Example 3 to obtain a pitch having a softening point of 315° C., a quinoline insoluble content of 50 wt. % and a mesophase content of 90%. The pitch thus obtained was melt-spun at 360° C. by means of the spinning apparatus used in Example 1 to obtain fiber of 18–25μ, which was then rendered infusible, carbonized and graphitized in the same manner as in Example 1 to obtain carbon fiber. The tensile strength and Young's modulus of this carbon fiber were 185 kg/mm$^2$ and 35 ton/mm$^2$, respectively.

What is claimed is:

1. A starting pitch for producing carbon fiber therefrom consisting essentially of a mixture of (a) 100 parts by weight of a petroleum pitch and (b) 5 to 500 parts by weight of a methanol-insoluble and benzene-soluble component contained in a heavy oil obtained in a fluid catalytic cracking of petroleum, said heavy oil having a boiling range not lower than 200° C., said component having been obtained by treating said heavy oil with methanol and benzene so as to remove methanol soluble and benzene insoluble fractions therefrom while retaining therein methanol-insoluble and benzene-soluble fractions.

2. The starting pitch for producing carbon fiber as set forth in claim 1, wherein said heavy oil has been heat-treated in advance at a temperature ranging from 350° to 500° C.

3. The starting pitch for producing carbon fiber as set forth in claim 1, wherein said heavy oil has been heat-treated in advance at a temperature ranging from 350° to 500° C. under a hydrogen pressure not lower than 20 kg/cm$^2$·G.

4. The starting pitch for producing carbon fiber as set forth in claim 1, wherein said component (b) is insoluble in a 2:1 (weight ratio) mixture of methanol and benzene and is soluble in benzene.

5. The starting pitch for producing carbon fiber as set forth in claim 1, wherein said component (b) is insoluble in a 1:1 (weight ratio) mixture of methanol and benzene and is soluble in benzene.

6. The starting pitch for producing carbon fiber as set forth in claim 2, wherein said component (b) is insoluble in a 2:1 (weight ratio) mixture of methanol and benzene and is soluble in benzene.

7. The starting pitch for producing carbon fiber as set forth in claim 3, wherein said component (b) is insoluble in a 2:1 (weight ratio) mixture of methanol and benzene and is soluble in benzene.

8. The starting pitch for producing carbon fiber as set forth in claim 2, wherein said component (b) is insoluble in a 1:1 (weight ratio) mixture of methanol and benzene and is soluble in benzene.

9. The starting pitch for producing carbon fiber as set forth in claim 3, wherein said component (b) is insoluble in a 1:1 (weight ratio) mixture of methanol and benzene and is soluble in benzene.

10. A mesophase pitch for use in making carbon fibers therefrom and formed from a heat treated mixture consisting essentially of (a) 100 parts by weight of a pitch and (b) 5 to 500 parts by weight of a methanol-insoluble and benzene-soluble component contained in a heavy oil obtained in a fluid catalytic cracking of petroleum, said heavy oil having a boiling range not lower than 200° C., and said component having been obtained by treating said heavy oil with methanol and benzene so as to remove methanol-soluble and benzene-insoluble fractions therefrom while retaining therein methanol-insoluble and benzene-soluble fractions.

11. A mesophase pitch as in claim 10 wherein said heavy oil has been heat-treated in advance at a temperature ranging from 350° to 500° C.

12. A mesophase pitch as in claim 11 wherein said heavy oil has been heat-treated under a hydrogen pressure not lower than 20 kg/cm$^2$.

13. A mesophase pitch as in claim 10 wherein said component (b) is insoluble in a 2:1 weight ratio mixture of methanol and benzene.

14. A mesophase pitch as in claim 10 wherein said component (b) is insoluble in a 1:1 weight ratio mixture of methanol and benzene.

15. In a process for spinning carbon fibers from a pitch based composition the improvement comprising employing, as such composition, that of claim 10.

16. A process as in claim 15 further comprising the carbonization of said carbon fibers.

17. A process as in claim 16 further comprising the graphitization of the carbonized fibers.

* * * * *

UNITED STATES PATENT AND TRADEMARK OFFICE

CERTIFICATE OF CORRECTION

PATENT NO. : 4,579,645

DATED : April 1, 1986

INVENTOR(S) : Seiichi Uemura, et al.

It is certified that error appears in the above-identified patent and that said Letters Patent are hereby corrected as shown below:

ON THE COVER PAGE

[30] Foreign Application Priority Data: please insert --April 19, 1982 Japan 63931/1982--.

Signed and Sealed this

Seventh Day of October, 1986

[SEAL]

*Attest:*

DONALD J. QUIGG

*Attesting Officer*

*Commissioner of Patents and Trademarks*